United States Patent [19]

Catlin

[11] 3,940,268

[45] Feb. 24, 1976

[54] METHOD FOR PRODUCING ROTOR DISCS

[75] Inventor: John P. Catlin, Beaver, Pa.

[73] Assignee: Crucible Inc., Pittsburgh, Pa.

[22] Filed: Apr. 12, 1973

[21] Appl. No.: 350,424

[52] U.S. Cl. ..... 75/208 R; 29/156.8 R; 75/214; 75/226

[51] Int. Cl.[2] ..... B22F 3/00; B22F 3/12

[58] Field of Search ..... 29/156.8 R; 75/208 R, 226, 75/214

[56] References Cited

UNITED STATES PATENTS

| | | | |
|---|---|---|---|
| 2,466,432 | 4/1949 | Jenkins | 75/208 R |
| 2,479,039 | 8/1949 | Cronstedt | 29/156.8 R |
| 2,769,611 | 11/1956 | Schwarzkopf | 75/208 R |
| 2,894,318 | 7/1959 | Bloomberg | 29/156.8 R |
| 2,957,235 | 10/1960 | Steinberg | 75/208 R |
| 3,000,081 | 9/1961 | Webb | 29/156.8 R |
| 3,032,864 | 5/1962 | Webb | 29/156.8 B |
| 3,622,313 | 11/1971 | Havel | 75/226 |
| 3,698,962 | 10/1972 | Kasak et al. | 75/226 |
| 3,773,506 | 11/1973 | Larker et al. | 75/226 |
| 3,803,702 | 4/1974 | Bratt et al. | 75/226 |

*Primary Examiner*—Benjamin R. Padgett
*Assistant Examiner*—B. Hunt

[57] ABSTRACT

The production of rotor discs by bonding a plurality of fully dense, preformed blades to a hub of compacted alloy powder. The blades are embedded in the uncompacted powder and by the use of hot isostatic compacting the powder is compacted to full density to form the hub and the blades are bonded thereto simultaneously.

7 Claims, 3 Drawing Figures

METHOD FOR PRODUCING ROTOR DISCS

Small gas turbines having a hub with a plurality of blades or vanes bonded thereto are used for a variety of applications including jet aircraft engines. These articles are constructed from various titanium-base alloy compositions, superalloys, elevated temperature steels, refractory metals, such as molybdenum and ceramic high-temperature materials.

Typically, small gas turbines for example use an investment cast one-piece rotor hub and blade design made from a superalloy, such as 713 LC. For larger turbines the blades are mechanically coupled to the hub by conventional "fir-tree" type joints. Although this method provides a more reliable, crack-resistant bond between the hub rim and the blades, it is impractical for small turbines because of the high machining costs involved.

It is accordingly the primary object of the present invention to produce rotor discs and the like by means of a powder metallurgy process in which preformed, fully dense blades are bonded to the hub of a disc of alloy powder by hot isostatic compacting; in this manner it is possible to provide the required fatigue strength in the hub rim area to prevent cracking during high temperature service and yet achieve the desired high temperature strength in the blades.

This and other objects of the invention as well as a complete understanding thereof may be obtained from the following description, specific examples and drawings, in which.

Broadly in the practice of the invention a fully dense preformed alloy projection, typically in the form of a rotor disc blade, is initially embedded in a base or hub of alloy powder which is defined in a mold having a cavity conforming to the desired configuration of said base or hub. The mold must be of a nondeformable material such as molybdenum or various nondeformable ceramic compositions, such as 95% alumina with a binder of colloidal silica. Typically the mold cavity with the powder contained therein would be evacuated, preferably after heating to an intermediate temperature, to remove impurities in the form of gaseous reaction products, particularly oxygen. Thereafter, the mold cavity would be sealed against the atmosphere and the mold assembly and alloy powder would be heated to an elevated temperature suitable for hot isostatic compacting to final densities approaching 100% of theoretical density. Although the temperature for this purpose would be dependent upon the particular material being compacted and the compacting pressure, temperatures within the range of 1500° to 2400°F would be generally suitable.

Hot isostatic compacting is achieved by the use of a conventional autoclave wherein the compacting pressure is provided by a fluid pressure medium, which is usually gas at pressures within the range of 300 to 60,000 psi and preferably within the range of 10,000 to 20,000 psi; by the application of suitable fluid pressure at elevated temperature the base or hub of alloy powder is compacted to final density and simultaneously the projection or blade is bonded thereto metallurgically. Although various materials may be used for the blades and the hub, in the production of rotor discs superalloys and titanium-base alloys are particularly well suited. It is necessary that the mold in which the alloy powder of the hub is confined be of a nondeformable material so that during hot isostatic compacting the same is not deformed to the extent that the final compacted product is not of the configuration desired, thus requiring extensive machining and defeating the purpose of the invention in achieving an economical practice. When employing molybdenum molds it is preferred to use rapid heating, compacting and cooling cycles to avoid the tendency of the alloy powder to bond to the mold walls. In applications involving the production of rotor discs, for which the invention is particularly adapted, the material or alloy of the powder constituting the hub portion will be of substantially the same alloy composition as that of the preformed blades; however, this need not necessarily be the case, and if warranted by a particular application the blades and hub may be of different material as long as a desired integral bond may be achieved during hot isostatic compacting of the alloy powder to full density.

Figure 1:
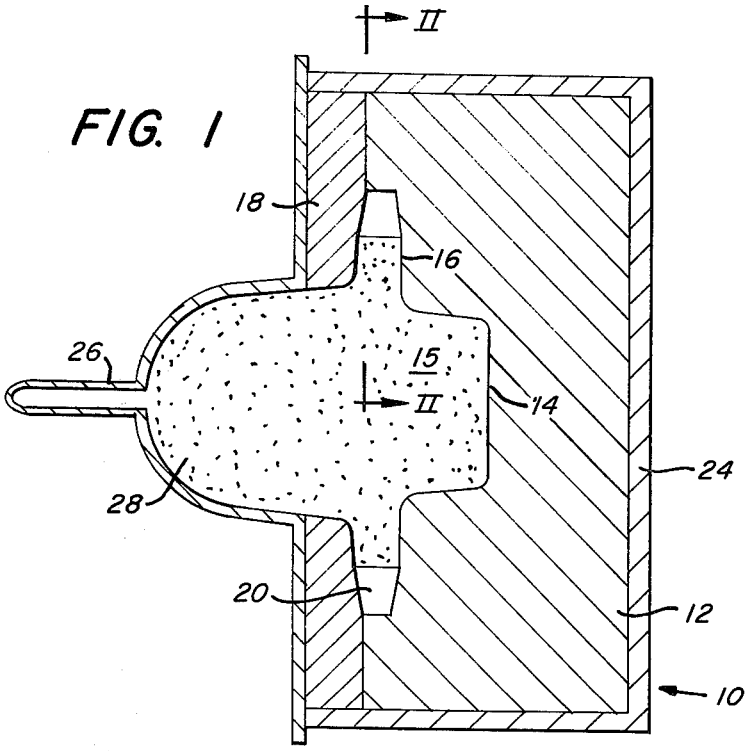
FIG. 1 is a vertical section through an assembly suitable for use in the practice of the invention is producing rotor discs.
Figure 2:
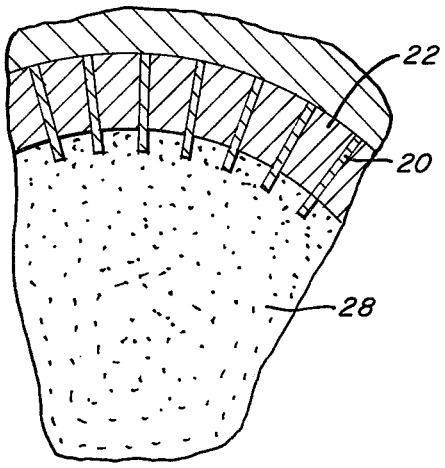
FIG. 2 is a sectional view of a portion of the assembly of FIG. 1 taken along lines II—II of FIG. 1.

With reference to the drawings there is shown in FIGS. 1 and 2 an assembly, designated generally as 10, suitable for use in the method of the invention to produce a rotor disc. The assembly 10 has a mold 12 of a nondeformable material such as molybdenum. The mold 12 has a mold cavity 14 having a major cavity portion 15 machined to the configuration desired in the hub portion of the rotor disc and a second annular portion 16 communicating with the cavity 14. The mold 12 has a ring 18 overlying and defining a surface of the annular portion 16 of the mold cavity. Positioned within the annular portion 16 are a plurality of preformed, fully dense blades 20 separated and maintained in spaced apart relation by molybdenum spacers 22. Insertion of the blades 20 and spacers 22 and accurate arrangement thereof in the annular portion 16 of the mold is facilitated by ring 18, which is removed during assembly of the blades and spacers and then placed in position thereafter. The mold with the blades 20 and spacers 22 in position as shown in FIG. 2 of the drawings is placed in a mild steel collapsible container 24 having a stem portion 26 connected to the interior of the mold which is filled with alloy powder material 28 of minus 20 mesh U.S. Standard from which the hub of the rotor disc is to be constructed. The stem 26 facilitates outgassing of the mold interior by connection to a vacuum pump (not shown) and thereafter may be sealed, as shown in FIG. 1 of the drawings, to render the assembly gas tight. As earlier described this assembly may be, after suitable outgassing, heated to elevated temperature and placed in an autoclave for compacting the alloy powder 28 to a final density approaching 100% of theoretical density; this operation simultaneously bonds the blades 20 metallurgically to the compacted powder, and provides a hub configuration corresponding to that of the mold cavity 14. Upon the application of fluid pressure in the autoclave, the container 24 collapses to permit compacting of the powder 28. Thereafter the mold and container may be stripped from the compact, the molybdenum inserts 22 removed and, after a light machining and polishing operation, the rotor disc is ready for use.

As one specific example of the practice of the invention compacting of a cast, fully dense pin to a powdered alloy charge of minus 60 mesh U.S. Standard was successfully performed with both the powdered alloy charge and the pin being of the following nickel-base, superalloy composition:

713 LC (Percent by Weight)

| Element | Composition |
|---|---|
| Carbon | .05 |
| Chromium | 12.00 |
| Aluminum | 6.00 |
| Molybdenum | 4.50 |
| Columbium | 2.00 |
| Titanium | .70 |
| Nickel | Balance |

Figure 3:
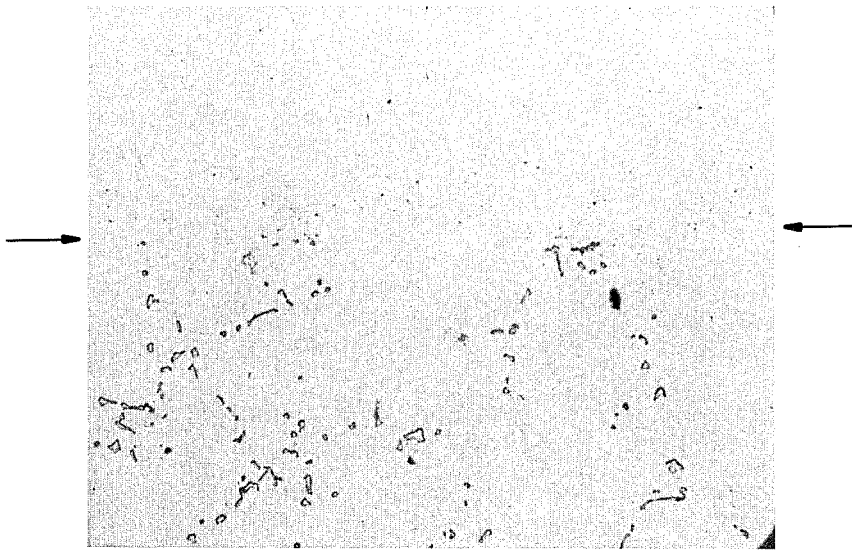
FIG. 3 is a photomicrograph (magnification 200X) showing the metallurgical bond, which is designated by the arrows, achieved between a preformed projection and compacted powder both of the nickel-base superalloy composition 713 LC.

This operation was performed by using an assembly similar to that shown in the figures with the assembly being outgassed during the initial stages of heating to a final compacting temperature of 2200°F. After outgassing, and prior to compacting at this temperature, the container was sealed against the atmosphere. It was transferred to an autoclave where compacting was performed at a pressure of 15,000 psi by the use of nitrogen gas. After compacting and removal of the mold and associated container, examination of the compacted article showed that the powdered charge was compacted to a density approaching 100% of theoretical and the pin was metallurgically bonded thereto. This result is clearly shown in the photomicrograph of FIG. 3. The arrows generally indicate the bond interface with the structure below the arrows being the cast pin and that above the arrows the compacted powder.

I claim:

1. A method for producing an article having at least one preformed alloy projection metallurgically bonded to a base of compacted alloy powder, said method comprising confining alloy powder in a cavity of a mold of nondeformable material, said mold cavity conforming to the desired configuration of said base of said alloy article, embedding a portion of said projection in said alloy powder within said mold cavity, sealing said mold cavity and said alloy powder confined therein against the atmosphere by enclosing the same in a collapsible container, heating said alloy powder, container and mold to an elevated temperature and compacting said alloy powder while at elevated temperature by the application of fluid pressure to compact the same to substantially full density and to metallurgically bond said preformed projection to said base of compacted alloy powder.

2. The method of claim 1 wherein said mold cavity is evacuated prior to compacting.

3. A method for producing a composite rotor disc having a hub of compacted alloy powder and a plurality of preformed alloy blades metallurgically bonded thereto, said method comprising confining alloy powder in a cavity of a mold of nondeformable material, said mold cavity having a first portion thereof conforming to the desired configuration of said hub and a second generally annular portion in communication with and surrounding said first portion, a plurality of preformed alloy blades positioned in spaced-apart relation with said second annular portion with a portion of each said blade being embedded in said alloy powder, sealing said mold cavity and said alloy powder confined therein against the atmosphere by enclosing the same in a collapsible container, heating said alloy powder, container and mold to an elevated temperature and compacting said alloy powder while at elevated temperature by the application of fluid pressure to compact the same to substantially full density to form said hub and to metallurgically bond said blades thereto.

4. The method of claim 3 wherein spacers of nondeformable material are positioned within said second annular portion of said mold cavity to maintain said blades in selected spaced-apart relation during said compacting and are removed thereafter to expose said blades.

5. The method of claim 3 wherein said compacting is performed with said alloy powder at a temperature within the range of 1500° to 2400°F and by the application of fluid pressure within the range of 300 to 60,000 psi.

6. The method of claim 3 wherein said alloy powder and said preformed alloy blades are of substantially the same alloy composition.

7. The method of claim 3 wherein said alloy of both said alloy powder and said preformed alloy blades is an alloy selected from the group consisting of superalloys and titanium-base alloys.

* * * * *